United States Patent [19]

Yoshida et al.

[11] Patent Number: 4,671,058

[45] Date of Patent: Jun. 9, 1987

[54] HEATING DEVICE

[75] Inventors: Hitoshi Yoshida, Okazaki; Hirohumi Suzuki, Kariya; Kazuo Oyobe, Oobu; Etsuji Nomura, Ichinomiya; Kazuma Matsui, Toyohashi; Naoto Miwa, Tsushima, all of Japan

[73] Assignee: Nippondenso Co., Ltd., Kariya, Japan

[21] Appl. No.: 671,611

[22] Filed: Nov. 15, 1984

[30] Foreign Application Priority Data

| | | | |
|---|---|---|---|
| Nov. 21, 1983 | [JP] | Japan | 58-219081 |
| Dec. 14, 1983 | [JP] | Japan | 58-235710 |
| Dec. 16, 1983 | [JP] | Japan | 58-238678 |
| Jan. 23, 1984 | [JP] | Japan | 59-10601 |

[51] Int. Cl.[4] ..... F01N 3/02; H01C 1/00

[52] U.S. Cl. ..... 60/303; 55/466; 55/DIG. 30; 219/375; 219/553; 338/330; 338/333

[58] Field of Search ..... 60/303; 55/DIG. 30, 55/466, 283; 219/375, 553, 374, 376, 381, 382; 338/326, 330, 333, 334

[56] References Cited

U.S. PATENT DOCUMENTS

| | | | |
|---|---|---|---|
| 2,261,667 | 11/1941 | Stroszeck | 338/333 |
| 2,330,652 | 9/1943 | Weigand | 338/333 |
| 2,570,692 | 10/1951 | Knight | 338/330 |
| 2,992,959 | 7/1961 | Schrewelius | 338/330 |
| 3,681,737 | 8/1972 | Magnusson | 219/375 |
| 3,691,346 | 9/1972 | Dyre | 219/375 |
| 3,875,476 | 4/1975 | Crandall | 338/330 |
| 3,875,477 | 4/1975 | Fredriksson | 338/330 |
| 4,505,107 | 3/1985 | Yamaguchi | 55/283 |
| 4,535,589 | 8/1985 | Yoshida | 55/283 |
| 4,555,358 | 11/1985 | Matsushita | 219/553 |

*Primary Examiner*—Douglas Hart

*Attorney, Agent, or Firm*—Cushman, Darby & Cushman

[57] ABSTRACT

A heating device of the present invention has a heating element of a substantially V-shape and is made of a ceramic material having electric conductivity. Electrode plates are respectively mounted at both ends of the heating element for energizing the heating element. Further, the heating device has a holder for holding the heating element by interposing both ends of the heating element therebetween. This holder is composed of a pair of insulating plates made of an electric insulating material. Both ends of the heating element are formed with projections. One of the insulating plates is formed with recesses for receiving both ends of the heating element in coincidence with the shape of both ends of the heating element.

24 Claims, 31 Drawing Figures

HEATING DEVICE

Background of the Invention

The present invention relates to a heating device and, more particularly, to a heating device having a ceramic heating resistor or so-called ceramic heater adapted for an exhaust gas cleaning apparatus of an internal combustion engine.

In order to clean the exhaust gas of an engine such as a diesel engine, an exhaust gas cleaning apparatus is used. This cleaning apparatus has a ceramic filter. This filter is formed in a porous structure, for example, a honeycomb structure. Therefore, when the cleaning apparatus having a filter of such a structure is provided in the exhaust gas passage of the engine, fine particles mainly containing carbon included in the exhaust gas passing through the passage are collected by the filter, thereby cleaning the exhaust gas discharged from the passage into the atmosphere.

When the cleaning apparatus is being used for a long period of time, the filter is clogged by the particles collected by the filter. Since the flowing resistance of the passage thus increases, the cleaning apparatus cannot preferably discharge the exhaust gas through the passage, thereby resulting in a decrease in the output of the engine.

To prevent the above-described drawbacks, the cleaning apparatus has a heating device disposed at the upstream side of the filter as seen from the flowing direction of the exhaust gas. This heater has, for example, an electric heater having heating wires. The cleaning apparatus having such an electric heater can burn and remove the fine particles of carbon collected by the filter by energizing the electric heater when the filter is clogged, thereby regenerating the filter.

Since the electric heater, i.e., the heating wires made of metal, is exposed with the high temperature exhaust gas in the cleaning apparatus, the heating wires are remarkably damaged due to oxidation and corrosion, thereby causing the wires to be disconnected. In other words, the electric heater has a disadvantage in its durability.

SUMMARY OF THE INVENTION

It is an object of the present invention to provide a heating device which is capable of providing excellent heat resistance and corrosion resistance and uniformly heating an element to be heated.

It is another object of the present invention to provide a heating device adapted for the above-described exhaust gas cleaning apparatus of an internal combustion engine.

The above first object of the present invention is achieved by a heating device comprising a flat heating element, bent so both ends approach each other, having an electric conductivity and made of a ceramic material for generating heat upon electrically energizing; and electrode means respectively mounted at both ends of the heating element for energizing the heating element.

According to one aspect of the invention, the heating element is formed of a ceramic material, and the heating device accordingly has excellent heat resistance and corrosion resistance to improve its durability.

According to the heating device of the first embodiment of the invention, the electrode means are mounted at both ends of the heating element. Thus, the heating element is inevitably supported in a cantilever state.

When the heating element is supported in the cantilever state, the supporting structure allows free thermal expansion and contraction of the heating element. Therefore, unreasonable force is not applied to the support of the heating element, the thermal deformation of the heating element can be thus prevented, and the heating element can be reliably retained.

In the first embodiment of the present invention, the sectional area of the leg portion between the bent part and both ends of the element is formed to be smaller than that of the bent part of the element. Thus, the substantial-current-passing section of the current flowing from one end to the other end of the heating element can be uniformly formed along the current flowing direction, thereby resulting in the possibility of uniformly generating heat from the entire heating element.

The second object of the invention is achieved by a heating device. This device is adapted for an exhaust gas cleaning apparatus having a filter element, the cleaning apparatus being provided in an exhaust gas passage of an internal combustion engine. The filter element is capable of collecting fine particles of carbon contained in the exhaust gas flowing through the exhaust gas passage. The heating device comprises a heating unit disposed in the vicinity of the end face of the filter, which is located at the upstream side as seen from the exhaust gas flowing direction. The heating unit includes flat heating elements, each of heating elements being bent so both ends approach each other, having electric conductivity and made of a ceramic material for generating heat when electrically energized. The heating elements are disposed at equal intervals in the circumferential direction of the filter so that the both ends of the heating elements are positioned outside of the filter. Electrode means are respectively mounted at both ends of the respective heating elements, and a mounting means are provided for retaining both ends of the heating elements and mounting the entire heating means in the exhaust gas cleaning apparatus.

According to the other aspect of the invention, the heating elements of the heating means are made of a ceramic material. Thus, even if the heating elements are exposed with high temperature exhaust gas, the heating elements can not only sufficiently endure against the exhaust gas, but can also prevent thermal deformation and can be reliably retained since the heating elements are respectively supported in a cantilever state. The heating elements are disposed at equal intervals in the circumferential direction of the filter in the heating means, and can accordingly heat the entire end faces of the filter at the upstream side. Therefore, the heating elements can preferably burn and remove the fine particles of carbon collected in the filter in the vicinity of the end face of the filter at the upstream side. Consequently, the heating elements can burn and remove not only the fine particles of carbon collected in the filter in the vicinity of the end face of the filter at the upstream side but also the fine particles of the carbon collected in the entire filter.

In the second embodiment of the invention, the heating elements have at both ends engaging portions, and the mounting means have a pair of holder plates, including electric insulation, for holding both ends of the heating elements. At least one of the holder plates has at least one recess for receiving both ends, including the engaging parts of the heating element. Therefore, when the heating element of the above-described structure is interposed between the pair of the holder plates, the heating element is reliably prevented from being disconnected from the holder plate. Consequently, the heating device of the second embodiment of the invention is adapted for the heating device of the exhaust gas cleaning apparatus in which the vibration of the engine is vigorously transmitted.

The other objects and advantages of the present invention can be readily clarified from the detailed description of the embodiments when taken in conjunction with the accompanying drawings.

DETAILED DESCRIPTION OF THE PREFERRED EMBODIMENTS

Figure 1:
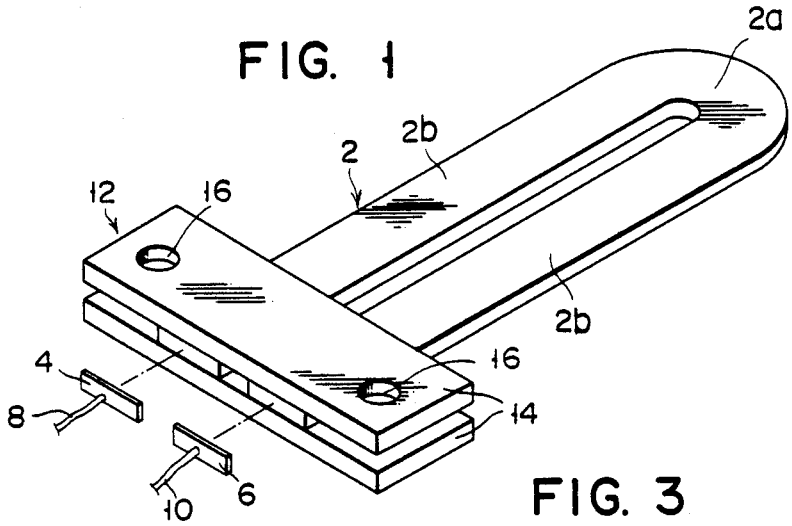
FIG. 1 is a perspective view of a heating device of a first embodiment according to the present invention.
Figure 3:
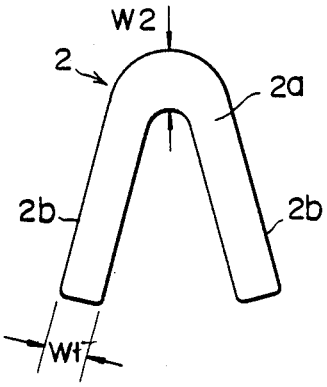
FIGS. 2 through 11 are front views showing modified examples of the heating element.

A first embodiment of a heating device according to the present invention will be described in detail with reference to FIG. 1. This heating device has, for example, a flat U-shaped heating element 2. This heating element 2 is formed of a ceramic material having electric conductivity. More particularly with respect to the manufacture of the heating element 2, 30% by weight of titanium nitride (average particle diameter: 1 μm) and 70% by weight of silicon nitride (average particle diameter: 0.8 μm) are first wet blended, and the mixture is then dried. A small amount of polyvinyl alcohol is added as a binder to the dried mixture to produce molding powder of the heating element. Then, the molding powder is filled and pressed in a metal mold, and is molded in the shape of the above-described heating element 2. The pressed molding powder thus molded is then heated at 1800° C. for 2 hours in a nitrogen gas atmosphere, thereby providing a completed product of the heating element 2.

Electrode plates 4, 6 made of nickel are provided to be electrically connected to both ends of the heating element 2. Metal lead wires 8, 10 are respectively connected electrically to the plates 4, 6. One of the lead wires 8, 10 is connected to a D.C. power source (not shown) and the other is grounded. Therefore, when a D.C. voltage is applied to both ends of the heating element 2, a current flows from one end to the other of the heating element 2, thereby allowing the heating element 2 to generate heat by means of electric resistance of the heating element 2 itself.

Further, the heating device has a holder 12 for holding the heating element 2. The holder 12 has a pair of electrically insulating plates 14 as shown in FIG. 1. A pair of bolt inserting holes 16 are respectively formed at both ends of the plates 14. Therefore, both ends of the heating element 2 are interposed between the pair of plates 14, and bolts (not shown) are respectively inserted into the holes 16 of the plates 14 and clamped by nuts (not shown), thus holding the heating element 2 by the holder 12.

According to the heating device of the first embodiment as described above, the heating element 2 is formed of the ceramic material. Thus, the heating element 2 has excellent heat resistance and corrosion resistance. Since the heating element 2 is interposed between the pair of insulating plates 14, unreasonable force due to the clamping of the bolts is not applied to the heating element 2, but the heating element 2 can be stably retained.

Assume that the heating element 2 is formed by bending the plate having the same size in width along the lengthwise direction when the above described U-shaped heating element 2 is heated by energizing the heating element 2. In this case, the heating element 2 first generates heat at the inner peripheral side of the bent portion 2*a*. This is because the current flowing through the bent portion 2*a* is concentrated at the inner peripheral side of the bent portion 2*a*. The fact that the inner peripheral side of the bent portion 2*a* in the heating element 2 is first heated is not preferred since the object to be heated cannot be uniformly heated when heated by the heating device.

In order to uniformly heat the heating element 2, it is necessary to reduce the sectional area of the bent portion 2*a* to be smaller than that of the sections between the bent portion 2*a* and both ends of the heating element 2, i.e., the legs 2*b* of the heating element 2. In other words, since the substantial-current-passing section of the current flowing from one end to the other end of the heating element 2 becomes substantially constant along the current flowing direction when the sectional areas of the portions of the heating element 2 are formed as described above, the heating element 2 can uniformly generate heat.

Various means may be employed to reduce the substantial-current-passing section of the legs 2*b* of the heating element 2 so it will be smaller than that of the bent portion 2*a* of the element 2. Referring to FIGS. 2 to 11, modified examples of the heating element 2 are respectively shown. A plurality of slits 18 are formed at both legs 2b of the heating element 2 in FIG. 2. The slits 18 are disposed on a rectilinear line of each leg 2b. In the heating element 2 of FIG. 3, the width W1 of both legs 2b is formed to be smaller than the width W2 of the bent portion 2a. Further, in the heating element 2 of FIG. 4, long slits 20 are formed on both legs 2b.

In the all heating elements 2 described above of FIGS. 2 and 3, the sectional area of the legs 2b can be reduced to be smaller than that of the bent portion 2a.

Figure 5:
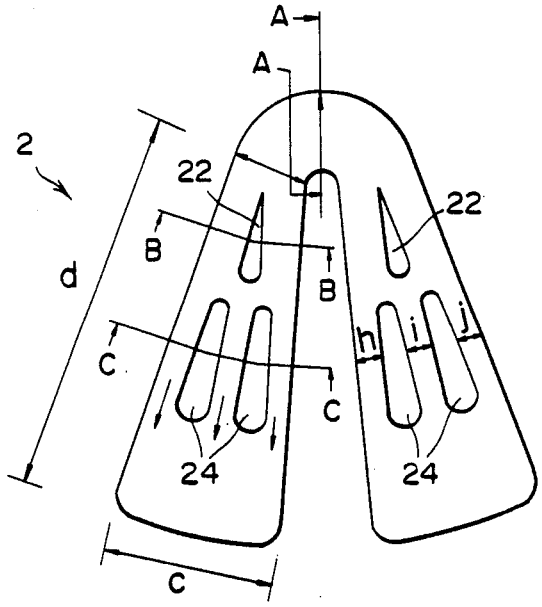

Further, in the heating element 2 of FIG. 5, the width of both legs 2b are gradually increased in V-shape toward both ends. Convergent slits 22 are formed on both legs 2b of the heating element 2 at the bent side 2a. Further, a pair of slits 24 having convergent and round ends are disposed in parallel at the end sides on both legs 2b of the heating element 2. In this case, in the heating element 2 of FIG. 5, the sectional area of the leg 2b along the line B—B is equal to that of the leg 2b along the line C—C and is smaller than that of the bent portion 2a along the line A—A. More specifically as to the sizes of the respective parts of the heating element 2

2 of FIG. 5, the heating element 2 has, for example, a=9 mm, b=8.8 mm, c=20 mm, d=45 mm, and 2 mm as the thickness of the heating element 2. The maximum length of the slit 22 is 10.9 mm, and the width of the center of the slit 22 is 2 mm. On the other hand, the maximum length of the slit 24 is 14.6 mm, and the width of the center of the slit 22 is 3 mm. Moreover, the widths h, i and j of the leg 2b divided by the slits 24 are equal in size. When the widths h, i and j of the leg 2b are thus formed equally, the decrease of the mechanical strength of the heating element 2, which is caused by forming the slots 24, can be suppressed to the minimum limit.

In the case of the above-mentioned heating element 2 of FIG. 5, the current flowing from one end to the bent portion 2a of the heating element 2 via one of the legs 2b is temporarily branched due to the presence of the slits 24, and then combined in the portion between the slits 24 and 22. The combined current is again branched by the slit 22, combined at the bent portion 2a, and flowed toward the other leg 2b. The flowing current, repeatedly branching and combining, is executed in the same manner as in the case of the heating element 2 having the slits of FIGS. 2 and 4.

Figure 2:
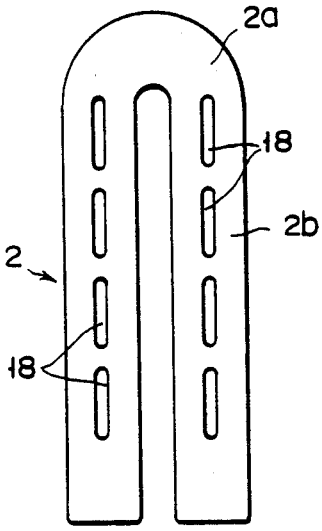
Figure 4:
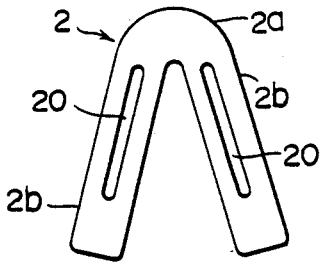

Further, as in the heating elements 2 of FIGS. 2, 4 and 5, the current-passing section of both ends of the heating element 2 having slits at the legs 2b can be increased to be larger than that of the legs 2b, and the heat generation at both ends of the heating element 2 can be suppressed to a small value. This can moderate the thermal load to be applied to the electrode plates 4, 6, considering the electrode plates 4, 6 which are connected to both ends of the heating element 2 are formed of metal. In this case, the sectional areas of both ends of the heating element 2 of FIG. 5 can be increased to be larger than that of the heating elements 2 of FIGS. 2 and 4. Consequently, it is preferable to alleviate the thermal loads of the electrode plates 4, 6.

Figure 6:
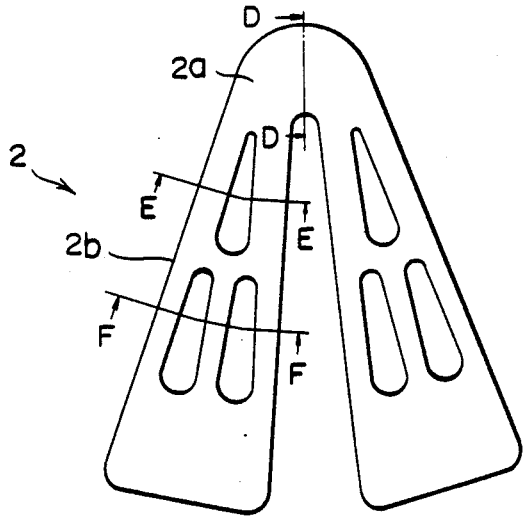
Figure 7:
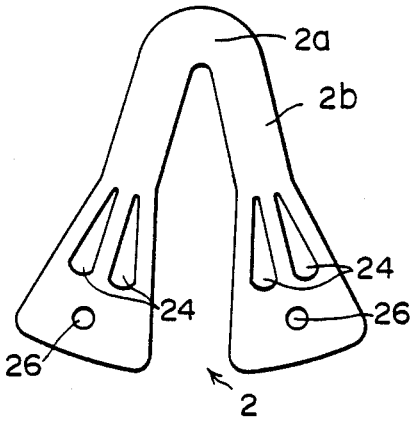

A heating element 2 of FIG. 6 is formed substantially in the same shape as the heating element of FIG. 5 except that the vertex of the bent portion 2a is projected and the thicknesses of the legs 2b are gradually reduced toward the ends as compared with the heating element of FIG. 5. Thus, in the heating element 2 of FIG. 6, the ratio of the sectional areas along the lines D—D, E—E and F—F is, for example, set to 1:0.8:0.7. The period of time required to uniformly heat the entire heating element 2 of FIG. 6 is shorter than that of the heating element 2 of FIG. 5. This is because the sectional area of the legs 2b of the heating element 2 of FIG. 6 is gradually reduced toward the end, and the thermal conduction of the heat generated at the legs 2b of the heating element 2 of FIG. 6 is suppressed more than that of the heating element 2 of FIG. 5 when the heat generated at the legs 2b of the heating element 2 of FIG. 6 partly escapes, by the thermal conduction, towards both ends of the heating element 2. More specifically, it takes approximately 1 minute to allow the entire heating element 2 of FIG. 5 to uniformly generate heat, while it takes only approximately 20 seconds to allow the entire heating element 2 of FIG. 6 to uniformly generate heat.

In the case of the heating element 2 of FIG. 6, the sectional area of the legs 2b is continuously reduced toward the end. However, the present invention is not limited to the particular embodiment. For example, the sectional area of the legs 2b may be varied in the longitudinal direction of the legs 2b. In summary, the sectional area of the legs 2b of the heating element 2 may be smaller than that of the bent portion 2a.

Further, when the thickness of the bent portion 2b of the heating element 2 at the inner peripheral side is increased to be larger than that at the outer peripheral side, the entire bent portion 2b can uniformly generate heat.

Referring to FIGS. 7 to 11, modified examples of a heating element 2 are exemplified. In a heating element 2 of FIG. 7, the legs 2b are gradually increased in width from the centers toward the ends of the legs 2b. In the heating element 2 of FIG. 7, bolt inserting holes 26 are formed at the both ends. When the holes 26 are thus formed at the heating element 2 itself, the heating element 2 may be mounted directly on the mounting member even if the holder 14 shown in FIG. 1 is not employed.

Figure 10:
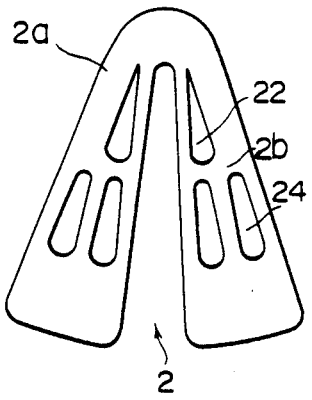
Figure 8:
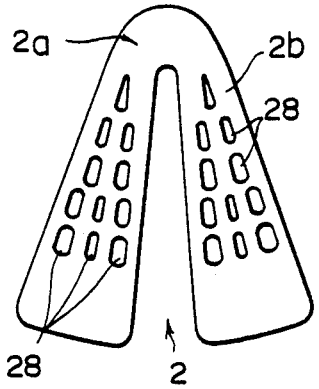
Figure 11:
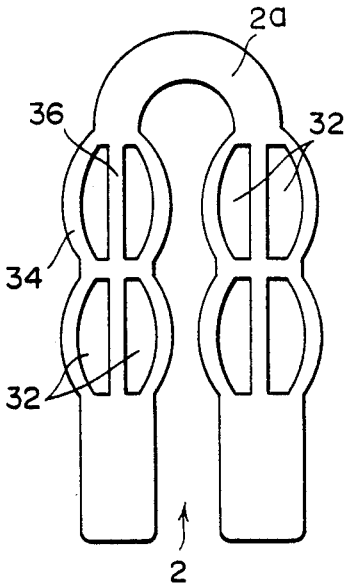
Figure 9:
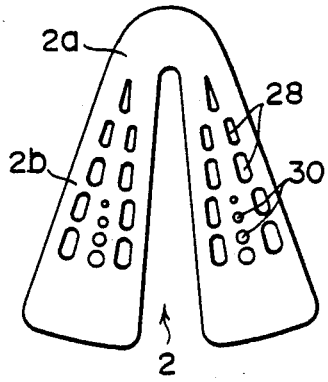

In the heating elements of FIGS. 8 and 9, a number of small slits 28 and pores 30 are formed over the entire legs 2b. The heating elements 2 of FIGS. 8 and 9 are preferable because they allow the legs 2b to uniformly generate heat. The heating element 2 of FIG. 10 is formed in such a manner that slits 22 are displaced toward the inside of the legs 2b as compared with the heating element of FIG. 4. In this case, when the width ratio of the branch passages divided by the slits 22 is within a range of 1:5, it is no problem for legs 2b to uniformly generate heat. A heating element 2 of FIG. 11 is formed fundamentally in the same manner as that of FIG. 4, except the length and thickness of the branch passages 34 and 36 which are defined by the slits 32 are determined so that the electric resistances of the passages are equal.

In the heating elements 2 described above, the shape and number of the slits are not limited to the particular examples described above. In summary, the shape and number of the slits may be determined by considering the uniform heat generation of the bent portion 2a and the legs 2b and the magnitude of the heat generated from the bent portion 2a and the legs 2b of the heating element 2.

Further, though not shown, slits may be formed at the bent portion 2a of the heating element 2, but even in this case, the sectional area of the bent portion 2a must be smaller than that of the legs 2b.

Figure 12:
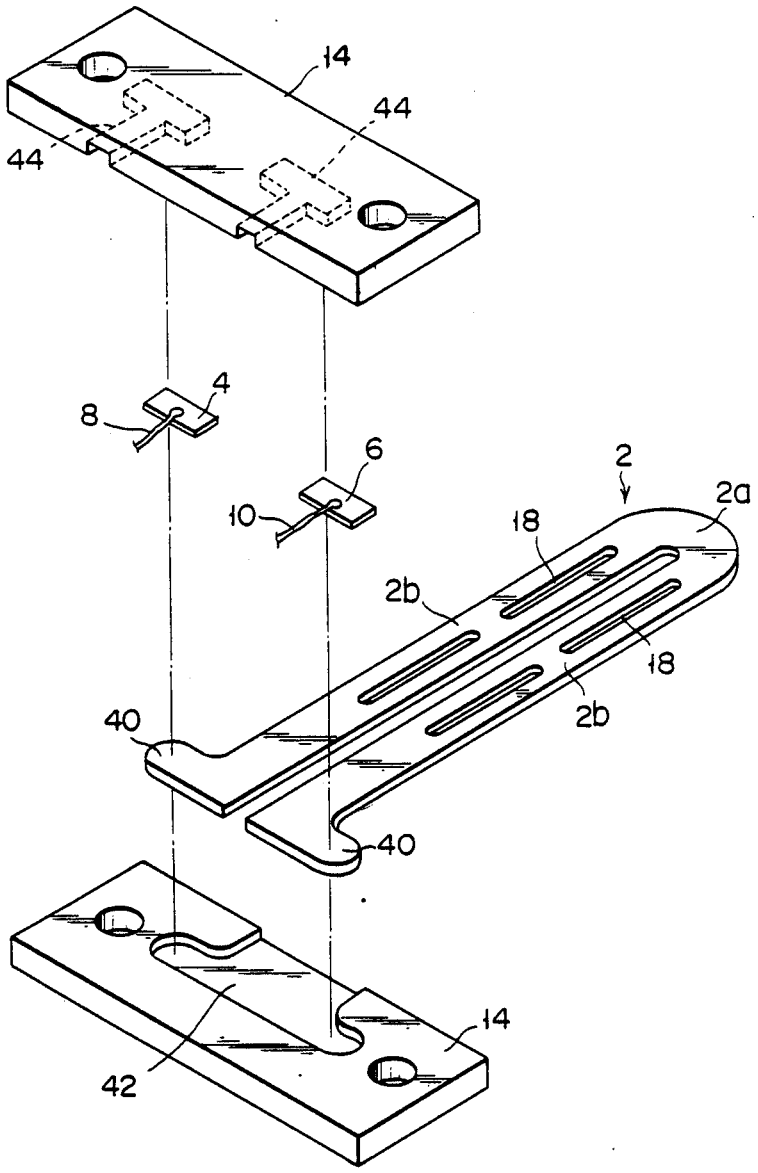
FIG. 12 is an exploded perspective view showing a heating device of a second embodiment according to the present invention.

Referring now to FIG. 12, a heating device of a second embodiment according to the present invention is shown. This heating device has fundamentally the same structure as that shown in FIG. 1, and only the difference will be described. The same reference numerals of the members described above in the first embodiment denote the same parts in the second embodiment, and the detailed description thereof will be omitted.

The heating element 2 of the heating device of FIG. 12 has at both ends semicircular projections 40 projected toward the outside in a direction perpendicular to the longitudinal direction of the legs 2*b*.

One insulating plate 14 of a holder 12 is formed with a first recess 42 having the same shape as both ends including the projections 40 of the heating element 2, and is capable of receiving both ends of the heating element 2. The other insulating plate 14 is formed with a pair of second recesses 44 capable of respectively receiving electrode plates 4, 6 and externally leading lead wires 8, 10 respectively connected to the plates 4, 6. The depth of the first recess 42 is substantially equal to the thickness of both ends of the heating element 2, and the depth of the second recess 44 is substantially equal to the thickness of the electrode plates. In fact, the sizes of the first and second recesses 42 and 44 are determined by considering the thermal expansion difference between the insulating plate 14 and the heating element 2.

When the heating device of FIG. 12 is set up, both ends of the heating element 2 are first fitted in the first recess 42 of the one insulating plate 24. The electrode plates 4, 6 are respectively fitted in the second recesses 44 of the other insulating plate 14, and the lead wires 8, 10 respectively are lead out through the second recesses 44. Then, these plates 14 are superposed and coupled to each other through the heating element 2 by bolts and nuts in the same manner as the heating device of FIG. 1, thereby completing the assembly of the heating device of FIG. 12. When thus completed, the electrode plates 4, 6 are respectively superposed on both ends of the heating element 2, and an electric connection between the plates 4, 6 and both ends of the heating element 2 is established. In other words, in the heating device of FIG. 12, not only both ends of the heating element 2 but also the electrode plates 4, 6 are interposed between the pair of insulating plates 14. Therefore, according to the heating device of FIG. 12 as described above, the heating element 2 can generate heat by flowing a current from one end to the other of the heating element 2 through the electrode plates 4, 6 in the same manner as the heating device of FIG. 1.

Further, the heating device of FIG. 12 has particular advantages in addition to those of the heating device of FIG. 1, as will be described. More specifically, in the heating device of FIG. 12, the heating element 2 is interposed between the pair of insulating plates 14 in the state that both ends having the projections 40 are fitted in the first recesses 42 of the plates 14. Therefore, the heating device of FIG. 12 can effectively prevent the heating element 2 from being removed from the holder 12. Consequently, the heating device of FIG. 12 has excellent vibration resistance as compared with that of FIG. 1. Further, in the heating device of FIG. 12, the electrode plates 4, 6 are also disposed within the holder 12. Thus, the oxidation and corrosion of the plates 4, 6 can be alleviated. In the heating device of FIG. 12, the first recess 42 is formed on one insulating plate 14. However, the first recesses 42 may be respectively formed on both insulating plates 14. Further, even when the projection 40 is formed only at one end of the heating element 2, the heating device can similarly prevent the heating element 2 from being removed.

The heating device of this type having excellent vibration resistance is not limited to the particular heating device of FIG. 12, and the modified example will be described.

Figure 13:
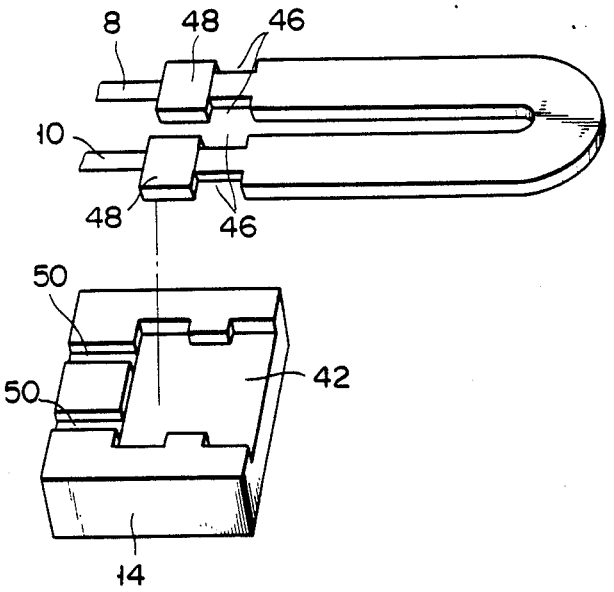
FIGS. 13 through 15 are exploded perspective views showing still another embodiments of a heating device of FIG. 12.

In a heating device of FIG. 13, a pair of rectangular notches 46 are formed at both side edges of both ends of a heating element 2. In this case, electrode layers 48 are respectively formed at both ends of the heating element 2. The electrode layers 48 are formed by burning together a conductive metal such as platinum, metallic nickel, or molybdenum on both ends of the heating element 2, or depositing a vaporized conductive metal on both ends of the heating element 2. Therefore, lead wires, 8, 10 are respectively connected electrically to the electrode layers 48.

In a holder 12 used for the heating device of FIG. 13, a first recess 42 for receiving both ends of the heating element 2 and a pair of notches 50 for leading lead wires 8, 10 are formed at one insulating plate 14. In FIG. 13, the other insulating plate 14 in the holder 12 is not shown.

Figure 14:
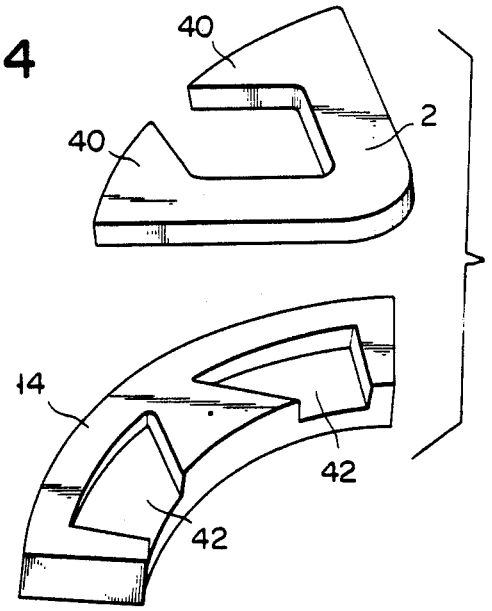

In a heating device of FIG. 14, a heating element 2 is formed substantially in a V-shape. In case of the heating element 2, projections 40 are formed in a triangular shape, and projected from the inside edges of the both ends of the heating element 2. In the heating device of FIG. 14, the insulating plate 14 of the holder 12 has a bent shape. The heating device having such a holder 12 is preferably used when a plurality of heating devices are aligned in a circular shape.

Figure 15:
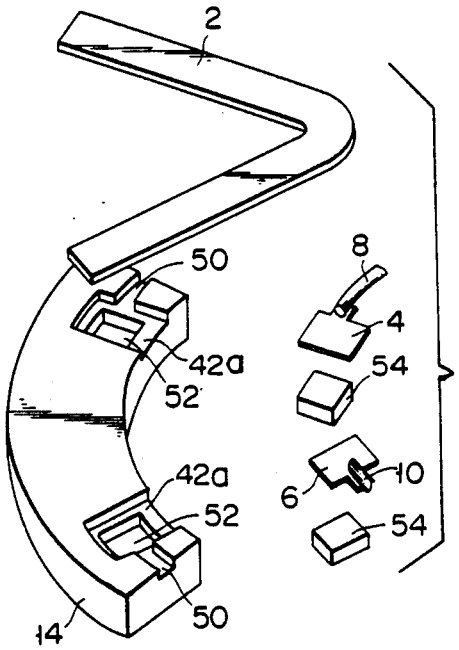

In the case of the heating device of FIG. 15, its heating element 2 is formed merely in a V-shape. Even if a projection 40 or a notch 46 is not formed at the heating element 2 as shown, the disconnection of the heating element 2 from the holder 12 may be reliably prevented in the same manner as the heating device of FIG. 12 by merely forming a pair of first recesses 42*a* in the same shape as both ends of the heating element 2, as shown in FIG. 15, and capable of receiving the both ends at one insulating plate 14 of the holder 12. In this case, the first recesses 42*a* are also used as recesses for containing the electrode plates. Further, in the case of the heating device of FIG. 15, third recesses 52 are respectively formed in the first recesses 42 of the insulating plate 14. Cushion materials or members 54 made of an inorganic material are respectively fitted in the third recesses 52. The cushion members 54 are formed of ceramic fiber contained therein, molded ceramic fiber or ceramic fiber and thermally expansion material (e.g., vermiculite). Thus, in the case of the heating device of FIG. 15, the cushion members 54 are respectively fitted in the third recesses 52 of the plate 14, and electrode plates 4, 6 are then respectively contained in the first recesses 42*a*. At this time, the lead wires 8, 10 of the plates 4, 6 are respectively lead out of the holder 12 through the notches 50 communicating with the first recesses 42*a*. Then, both ends of the heating element 2 are respectively engaged within the first recesses 42*a*, the other insulating plate 14 is then superposed on the insulating plate 14, and the plates 14 are coupled, thereby completing the assembling of the heating device of FIG. 15. The arrangement where both ends of the heating element 2, the electrode plates 4, 6 and the cushion members 54 are interposed between the pair of insulating plates 14 is shown in FIG. 16.

Figure 16:
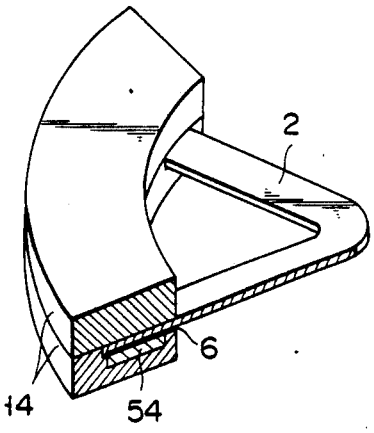
FIG. 16 is a fragmentary perspective view of the heating device of FIG. 15.

In the heating device of FIGS. 15 and 16, both ends of the heating element 2 are interposed elastically between the pair of insulating plates 14 by the cushion members 54, and the heating element 2 can be further effectively held by the holder 12. Since the electrode plates 4, 6 are pressed by the elastic forces of the cushion members 54 to both ends of the heating element 2, an electric connection between the electrode plates 4, 6 and both ends of the heating element 2 can be assured. In the heating device of FIG. 15, the third recesses 52 are determined in depth so as to produce elastic deformation in the cushion members 54 when the heating device is constructed as described above.

Figure 17:
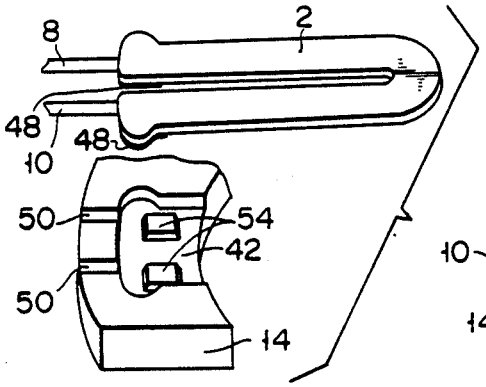
FIG. 17 is a partially exploded perspective view showing still another embodiment of the heating device of FIG. 12.
Figure 18:
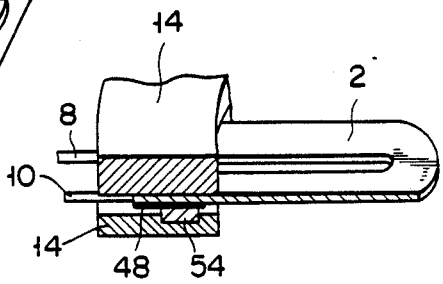
FIG. 18 is a fragmentary perspective view of the heating device of FIG. 17.

A heating device of FIG. 17 is constructed by combining respective constituent members of the heating device described above, and FIG. 18 is a fragmentary perspective view of the heating device of FIG. 17.

Figure 19:
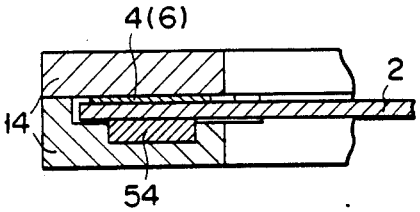
FIGS. 19 and 20 are sectional views showing the modified examples of the mounting disposition of a cushion member.

In a heating device of FIG. 19, the cushion members 54, as shown in the heating device of FIG. 16, do not press electrode plates directly toward the ends of the heating element 2, but the cushion members 54 press the ends of the heating element 2 toward the electrode plates.

Figure 20:
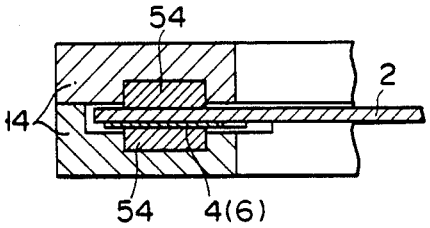

The heating device shown in the cross section in FIG. 20 has a pair of cushion members 54 for pressing the ends of a heating element 2 and electrode plates from both sides. According to the heating device of FIG. 20, electric contacts between both ends of the heating element 2 and the plates 4, 6 can be further effectively established.

Figure 21:
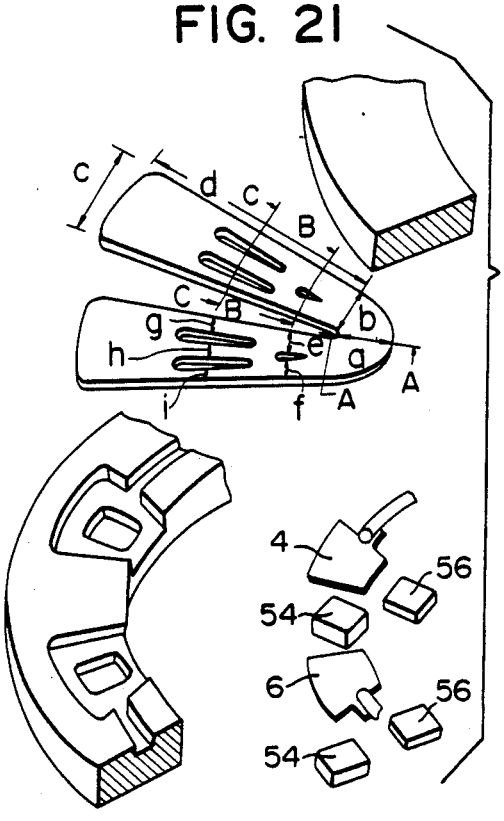
FIG. 21 is a partial exploded perspective view showing still another embodiment of a heating device of FIG. 12.
Figure 22:
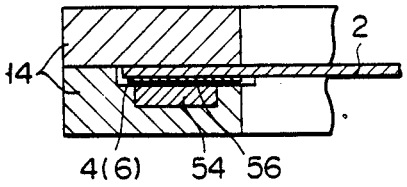
FIG. 22 is a sectional view of the heating device of FIG. 21.

Further, the heating device of FIG. 21 is an example of using the heating element 2 shown in FIG. 5. The heating device of FIG. 21 further has caps 56 for respectively covering the cushion members 54. These caps 56 are disposed between the electrode plates 4, 6 and the cushion members 54 as shown in FIG. 22. When the cushion members 54 are thus respectively covered with the caps 56, thermal load to be applied to the cushion members 54 can be moderated, thereby preventing the cushion members 54 from being deteriorated. Consequently, the lifetime of the cushion members 54 can be increased.

Figure 23:
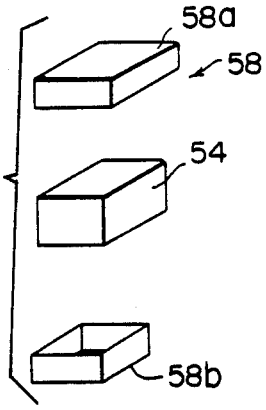
FIGS. 23 and 24 are perspective views showing the modified examples of a cushion member.
Figure 24:
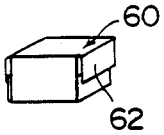
Figure 25:
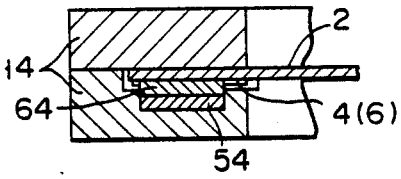
FIG. 25 is a sectional view showing another modified example of a cushion member.

Referring to FIGS. 23 through 25, modified examples of the cap are respectively shown. The cap 58 of FIG. 23 is formed of a box **58*b* with a cover 58*a* for containing the cushion member 54. In this case, the cover 58*a* is slidably engaged with the box 58*b*, thereby allowing the cushion member 54 to elastically deform. The cap 60 of FIG. 24 is formed of a pair of covers 62 slidably engaged with each other to surround the cushion member 54. The cap 64 of FIG. 25 is coupled integrally with an electrode plate. This cap 64 can position the electrode plate by engaging the cushion member 54 within the third recess 52**.

In the heating devices shown in FIGS. 13 through 18 and 21 described above, means such as bolt inserting holes for coupling a pair of insulating plates are not shown.

Figure 26:
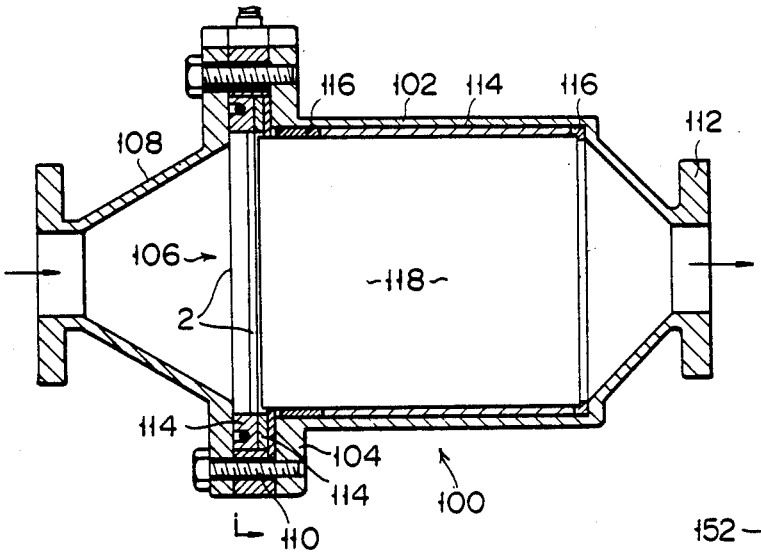
FIG. 26 is a sectional view of an exhaust gas cleaning apparatus having the heating device of a third embodiment according to the present invention.

Referring now to FIGS. 26 through 31, concrete examples of using the above-described heating device will be described. FIG. 26 shows an exhaust gas cleaning apparatus disposed in the course of the exhaust gas passage of an internal combustion engine. This apparatus has a stainless steel housing 100. This housing 100 is formed with a main body 102 of circular or elliptical section, and a flange 104 at one end of the body 102. An exhaust gas guide tube 108 is coupled via coupling bolts 110 at the flange 104 of the body 102 through a heating device 106 to be described later. This tube 108 is connected to the exhaust gas passage of engine side. On the other hand, an exhaust gas output tube 112 is formed integrally with the other end of the body 102. The exhaust gas output tube 112 is connected to the exhaust gas port side of the exhaust gas passage. An annular heat resistant buffer member 114 is disposed on the inner peripheral surface of the body 102. An annular sealing members 116 are disposed on the inner peripheral surface of the body 102 to hold the member 114.

A filter 118 is filled in the body 102. The filter 118 is formed of porous foamable ceramic materials with cordierite properties.

Therefore, according to the above-mentioned exhaust gas cleaning apparatus, exhaust gas from the engine flows through the tube 108, the filter 118 and the tube 112, and fine particles of carbon, contained as the main component included in the exhaust gas, can be collected by the filter 118. Thus, the exhaust gas discharged from the exhaust gas passage can be cleaned.

The above-described heating device 106 is utilized to burn the fine particles of carbon collected by the filter 118. As apparent from FIG. 26, the heating device 106 is disposed in the vicinity of the end face of the filter 118 at the upstream side as seen from the exhaust gas flowing direction.

Figure 27:
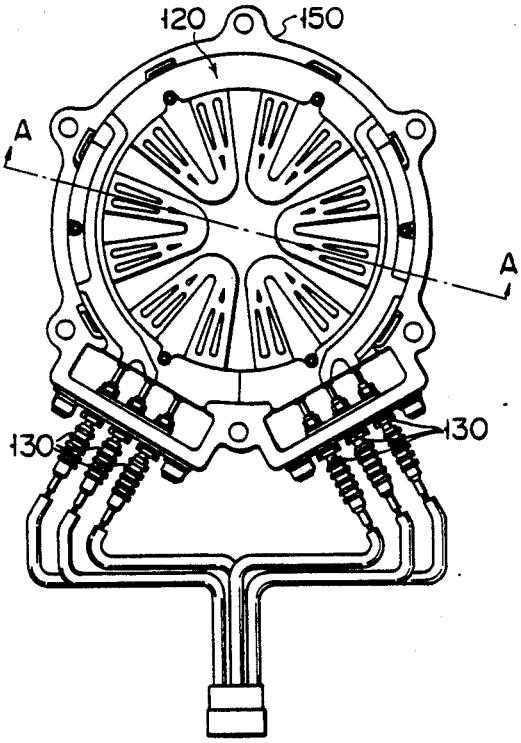
FIG. 27 is a front view of the heating device associated with the exhaust gas cleaning apparatus of FIG. 26.
Figure 28:
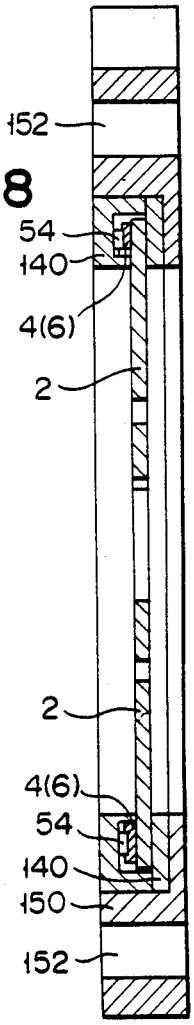
FIG. 28 is a sectional view of the heating device of FIG. 27.

The heating device 106 has, for example, six heating elements 2 as shown in FIG. 27. The heating elements 2 are the same as those shown in FIG. 21. Since the heating elements 2 of FIG. 21 can flow the exhaust gas through the slits formed at the heating elements 2, they are also adapted as the heating device of the exhaust gas cleaning apparatus. These heating elements 2 are close to the end face of the filter 118 at the upstream side, and disposed radially to the axis of the body 102 in the state that both ends thereof are directed toward the outside, and the bent portions **2*a* approach each other. Both ends of the heating elements 2 are retained by a holder 120. The holder 120 is formed of a pair of insulating plates 140 formed annularly, and the holder 120 holds these heating elements 2 by interposing both ends of the respective heating elements 2 between the pair of insulating plates 140 in the same manner as the case of the above-described holder 12. Further, one insulating plate 140 of the holder 120 is formed with the first recesses 42 of the insulating plate 14 shown in FIG. 21, the third recesses 52 of FIG. 22 and the notches 50 of the lead wires in accordance with the number of heating elements 2. As shown in FIG. 28, both ends of the respective heating elements 2 are retained by interposing the cushion members 54, electrode plates and caps between the pair of insulating plates 140. The lead wires connected to one electrode plate of the respective heating elements 2 are respectively led through the notches 50 and respectively connected to the connectors 130. The connectors 130 are connected to a battery, not shown. On the other hand, the lead wires connected to the other electrode plates of the respective heating elements 2 are grounded through the body 102**.

Further, the holder 120 is housed in an annular metal case 150 as shown in FIG. 28, and fastened to the case 150. The case 150 and the holder 120 are coupled, for example, by bolts and nuts. Further, the inserting holes 152 of the mounting bolts 110 are formed at the outer periphery of the case 150.

This heating device 160 can uniformly heat the end face of the filter 118 at the upstream side by heating the heating elements 2 through sequential energizing of the respective heating elements 2, thereby burning and removing the fine particles of carbon collected by the filter 118. In this manner, the clogging of the filter 118 can be eliminated to allow the filter 118 to be reused.

In the heating device 106, the heating elements 2 are effectively prevented from being disconnected from the holder 120 by the means shown in FIG. 21, and the heating elements 2 are stably retained by the holder 120 by means of the cushion members 54. Therefore, such a heating device is remarkably adapted for the exhaust gas cleaning apparatus to which large vibration is applied from the engine.

As was described above, the heating elements 2 are formed of a ceramic material. Therefore, even if the heating elements 2 are exposed to the exhaust gas, the elements 2 can sufficiently endure against the high temperature of the exhaust gas and the corrosion by the exhaust gas. In the case of the heating device, the electrode plates and the lead wires are contained in the holder 120. Therefore, the electrode plates and lead wires can also sufficiently endure against the high temperature of the exhaust gas and the corrosion by the exhaust gas.

Figure 29:
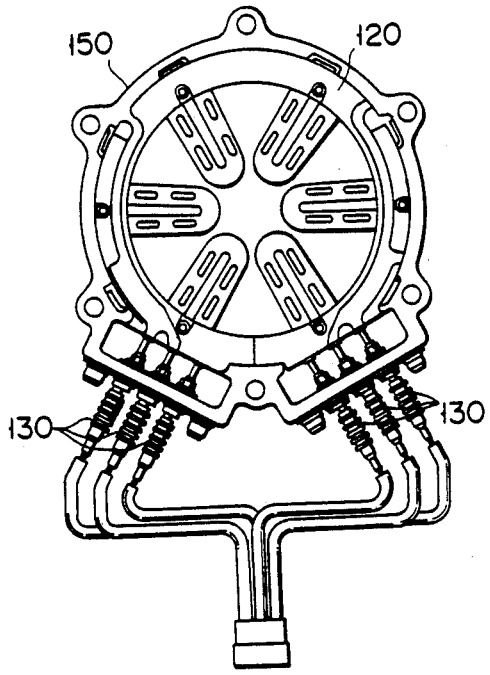
FIG. 29 is a front view showing the modified example of the heating device of FIG. 27.

The heating device adapted for the exhaust gas cleaning apparatus is not limited to the particular heating device 106 shown in FIGS. 27 and 28. For example, as shown in FIG. 29, a heating device using U-shaped heating elements 2 may be used, and further the heating device may be composed variously in combination with the above-described heating elements and holder.

Figure 30:
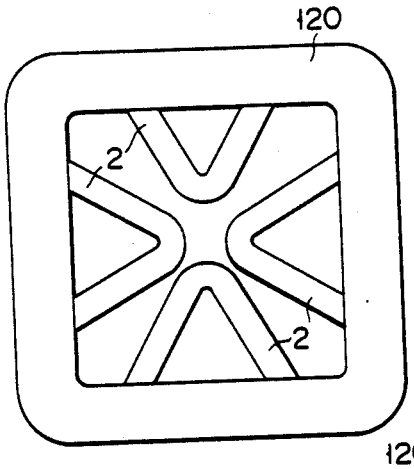
FIGS. 30 and 31 are front views showing the modified example of a holder used for the heating device of FIG. 26.

When the object to be heated is formed in a square shape, the holder 120 may be formed in a square shape as shown in FIG. 30. In other words, the shape of the holder 120 is determined in accordance with the shape of the object to be heated.

Figure 31:
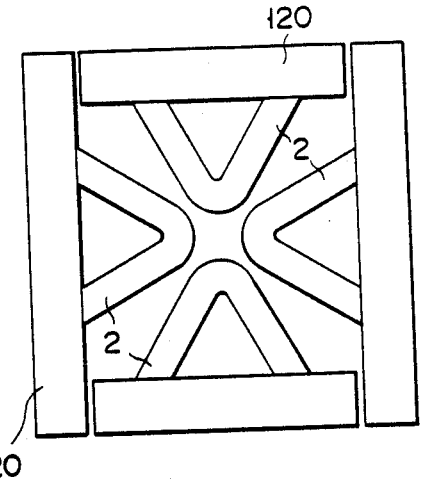

Further, to moderate the thermal load of the holder 120, the holder 120 may be formed of sections as shown in FIG. 31.

What is claimed is:

1. A heating device comprising:

a flat heating element bent to have both ends approach each other, having an electric conductivity and made of a ceramic material for generating heat upon being electrically energized;

electrode means, disposed at each end of the heating element, for electrically energizing the heating element; and a holder for holding the heating element and the electrode means by clamping them, said holder being formed of an electrically insulating material.

2. The heating device according to claim 1, wherein the heating element is formed by wet blending 30% by weight of titanium nitride and 70% by weight of silicon nitride and sintering the mixture in a predetermined shape.

3. The heating device according to claim 1, wherein the heating element is formed in a U-shape.

4. The heating device according to claim 1, wherein the heating element is formed in a V-shape.

5. The heating device according to claim 1, wherein the electrode means comprises electrode layers made of conductive metal respectively and formed on both ends of the heating element, and lead wires respectively connected to the electrode layers.

6. The heating device according to claim 1, wherein the heating element is formed so that the sectional area of portions between the bent portion thereof and the ends of the heating element, i.e., the legs thereof, is smaller than that of the bent portion.

7. The heating device according to claim 1, wherein both ends of the heating element have a sectional area larger than the average sectional area of the legs of the heating element.

8. The heating device according to claim 1, wherein the legs of the heating element are sequentially reduced in the thickness thereof toward the ends thereof.

9. The heating device according to claim 7, wherein the legs and ends of the heating element decrease in width thereof toward the bent portion of the heating element.

10. The heating device according to claim 1, wherein the holder comprises a pair of insulating plates made of electrically insulating material for interposing both ends of the heating element therebetween, and is formed with two inserting holes capable of inserting bolts for coupling the insulating plates therethrough at the respective insulating plates.

11. A heating device comprising:

a flat heating element bent to have both ends approach each other, having an electric conductivity and made of a ceramic material for generating heat upon being electrically energized, the heating element having constant thickness and width from one end to the other end thereof;

opening means for reducing average sectional area of the end portions of the heating element, i.e. the legs thereof; and electrode means for electrically energizing the heating element.

12. The heating device according to claim 11, wherein the opening means comprises at least one slit longitudinally extending at each of the leg of the heating element.

13. The heating device according to claim 11, wherein the opening means comprises a number of pores distributed over the entire legs of the heating element.

14. A heating device adapted for an exhaust gas cleaning apparatus which is provided in an exhaust gas passage of an internal combustion engine and has a filter element capable of collecting fine paticles of carbon contained in the exhaust gas flowing through the exhaust gas passage comprising:

a heating unit disposed in the vicinity of the end face of the filter located at the upstream side as seen from the exhaust gas flow direction, the heating unit including flat heating elements, each of the heating elements bent so that both ends approach each other and having electric conductivity and made of a ceramic material for generating heat upon being electrically energized, the heating elements being disposed at equal intervals in the circumferential direction of the filter so that both ends of the heating elements are positioned outside of the filter;

a plurality of electrode means, disposed at both ends of each heating system, for electrically heating the heating element; and a holder for holding the heating elements and the electrode means by clamping them and for mounting the heating unit in the exhaust gas cleaning apparatus, said holder being formed of an electrically insulating material.

15. The heating device according to claim 14, wherein the holder comprises a pair of electrically insulating plates with a ring shape for holding by interposing both ends of the heating elements therebetween.

16. The heating device according to claim 15, wherein at least one of the insulating plates is provided with the engaging means capable of receiving the ends of heating elements for preventing the heating elements from being disconnected from the insulating plates.

17. The heating device according to claim 16, wherein the engaging means comprises engaging portions formed at the side edges of both ends of each of the heating elements, and a recess formed at one end of the insulating plastes for receiving both ends having engaging portion of each of the heating elements and preventing the heating elements from being disconnected therefrom.

18. The heating device according to claim 17, wherein the engaging portions are projections projected from the side edge of both ends of the heating elements.

19. The heating device according to claim 17, wherein the engaging portions are notches formed at the side edges of both ends of each of the heating elements.

20. The heating device according to claim 14, wherein the heating elements have a plurality of slits for passing exhaust gas at the portion except both ends and the bent portion of the heating elements.

21. The heating device according to claim 15, wherein the holder comprises cushion members disposed between at least one insulating plate and the ends of each of the heating elements for elastically interposing both ends of each of the heating elements by the pair of insulating plates.

22. The heating device according to claim 21, wherein the holder comprises caps for covering the cushion members exposed with exhaust gas.

23. The heating device according to claim 22, wherein the electrode means comprise electrode plates formed integrally with the caps.

24. The heating device according to claim 15, wherein the insulating plate is divided at a plurality of portions in a circumferential direction.

* * * * *